US008590431B2

(12) United States Patent
Cook

(10) Patent No.: US 8,590,431 B2
(45) Date of Patent: Nov. 26, 2013

(54) PROTECTIVE GEAR SOCKET ASSEMBLIES AND METHODS OF FABRICATING THE SAME

(75) Inventor: Allen Mark Cook, San Antonio, TX (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 263 days.

(21) Appl. No.: 13/248,554

(22) Filed: Sep. 29, 2011

(65) Prior Publication Data

US 2013/0081522 A1 Apr. 4, 2013

(51) Int. Cl.
*B25B 13/08* (2006.01)
*B25B 13/48* (2006.01)

(52) U.S. Cl.
USPC ..... 81/58.2; 81/185.1

(58) Field of Classification Search
USPC ..... 81/58.2, 180.1, 124.2, 57.15, 57.33, 81/185, 185.1
See application file for complete search history.

(56) References Cited

U.S. PATENT DOCUMENTS

| | | | | |
|---|---|---|---|---|
| 2,324,187 | A | 7/1943 | Arthur | |
| 2,376,575 | A * | 5/1945 | Cronan | 192/43.2 |
| 2,758,493 | A * | 8/1956 | Goldwater | 81/58.2 |
| 3,433,108 | A | 3/1969 | Ondeck | |
| 4,836,067 | A | 6/1989 | Rogers et al. | |
| 4,899,625 | A | 2/1990 | Lymburner | |
| 4,928,558 | A | 5/1990 | Makhlouf | |
| 6,339,980 | B1 * | 1/2002 | Woolf | 81/185.1 |
| 6,397,706 | B1 | 6/2002 | Maznicki | |
| 2005/0022631 | A1 | 2/2005 | Brazil | |
| 2008/0245193 | A1 | 10/2008 | Lipka | |

* cited by examiner

*Primary Examiner* — David B Thomas
(74) *Attorney, Agent, or Firm* — Dinsmore & Shohl LLP

(57) ABSTRACT

A protective gear socket assembly includes a gear socket and an insert positioned in the gear socket. The gear socket includes a plurality of teeth projecting radially outward from a perimeter of the gear socket and a u-shaped channel formed through a thickness of the gear socket, a contact surface extending radially outward from an upper edge of the u-shaped channel of the gear socket, and at least one mounting hole formed in the contact surface. The insert includes a u-shaped channel formed through a thickness of the insert, a mating surface extending radially outward from a lower edge of the u-shaped channel of the insert, and at least one mounting post extending from the mating surface.

20 Claims, 7 Drawing Sheets

PROTECTIVE GEAR SOCKET ASSEMBLIES AND METHODS OF FABRICATING THE SAME

TECHNICAL FIELD

Embodiments provided herein generally relate to gear socket assemblies, and more specifically, to protective gear socket assemblies comprising a gear socket and a protective insert positioned on the gear socket.

BACKGROUND

In automotive manufacturing, torque tools may be used to tighten nuts that may be used to install automotive parts. For example, a torque tool may be used to tighten flare nuts used on brake tubes and/or rack and pinion fluid tubes. Such tubes may be made of metal and may be coated with a protective coating material. The protective coating material may prevent oxidation of the underlying metal, thereby reducing the likelihood of future fluid leaks caused by oxidation of the metal tubes.

A torque tool may have an open-end gear socket that is installed in the head of the torque tool. A traditional gear socket may be made of metal, such as hardened tool steel. Using a torque tool equipped with such a traditional metal gear socket to tighten flare nuts on tubes with protective coatings may cause damage, such as nicks and scratches, to the protective coating on the tubes. Such damage is particularly likely during insertion and removal of the tool. Such damage to the protective coatings of the tubes may cause the tubes to oxidize and prematurely fail.

Accordingly, a need exists for alternative gear sockets that mitigate damage to coatings applied to tubes, fasteners, and the like.

SUMMARY

In one embodiment, a protective gear socket assembly includes a gear socket and an insert positioned in the gear socket. The gear socket includes a plurality of teeth projecting radially outward from a perimeter of the gear socket and a u-shaped channel formed through a thickness of the gear socket. The u-shaped channel of the gear socket defines an opening at an edge of the gear socket. The gear socket further includes a contact surface extending radially outward from an upper edge of the u-shaped channel of the gear socket, and at least one mounting hole formed in the contact surface. The insert includes a u-shaped channel formed through a thickness of the insert. The u-shaped channel of the insert defines an opening at an edge of the insert. The insert further includes a mating surface extending radially outward from a lower edge of the u-shaped channel of the insert, and at least one mounting post extending from the mating surface. When the insert is positioned on the gear socket, the u-shaped channel of the insert is aligned with the u-shaped channel of the gear socket, the mating surface of the insert engages the contact surface of the gear socket, and the at least one mounting hole of the gear socket receives the at least one mounting post of the insert.

In another embodiment, a protective gear socket assembly includes a gear socket and an insert positioned on the gear socket. The gear socket includes a plurality of teeth projecting radially outward from a perimeter of the gear socket and a u-shaped channel formed through a thickness of the gear socket. The u-shaped channel of the gear socket defines an opening at an edge of the gear socket. The gear socket further includes a first contact surface extending radially outward from an upper edge of the u-shaped channel of the gear socket and a first contact wall extending axially upward from a radially outward edge of the first contact surface. The insert includes a u-shaped channel formed through a thickness of the insert. The u-shaped channel of the insert defines an opening at an edge of the insert. The insert further includes a first mating surface extending radially outward from a lower edge of the u-shaped channel of the insert and a first mating wall extending axially upward from a radially outward edge of the first mating surface. When the insert is positioned on the gear socket, the u-shaped channel of the insert is aligned with the u-shaped channel of the gear socket, the first mating surface of the insert engages the first contact surface of the gear socket, and the first mating wall of the insert engages the first contact wall of the gear socket.

In yet another embodiment, a method of fabricating a protective gear socket assembly includes providing a gear socket, and fabricating an insert. The gear socket includes a plurality of teeth projecting radially outward from a perimeter of the gear socket, a u-shaped channel formed through a thickness of the gear socket and defining an opening at an edge of the gear socket, and a contact surface extending radially outward from an upper edge of the u-shaped channel of the gear socket. The insert includes a u-shaped channel formed through a thickness of the insert and defining an opening at an edge of the insert, and a mating surface extending radially outward from a lower edge of the u-shaped channel of the insert. The method further includes positioning the insert over the gear socket such that the u-shaped channel of the insert is aligned with the u-shaped channel of the gear socket. The method further includes applying force to the insert such that the mating surface of the insert engages the contact surface of the gear socket, thereby forming a protective gear socket assembly.

DETAILED DESCRIPTION OF THE DRAWINGS

Figure 2:
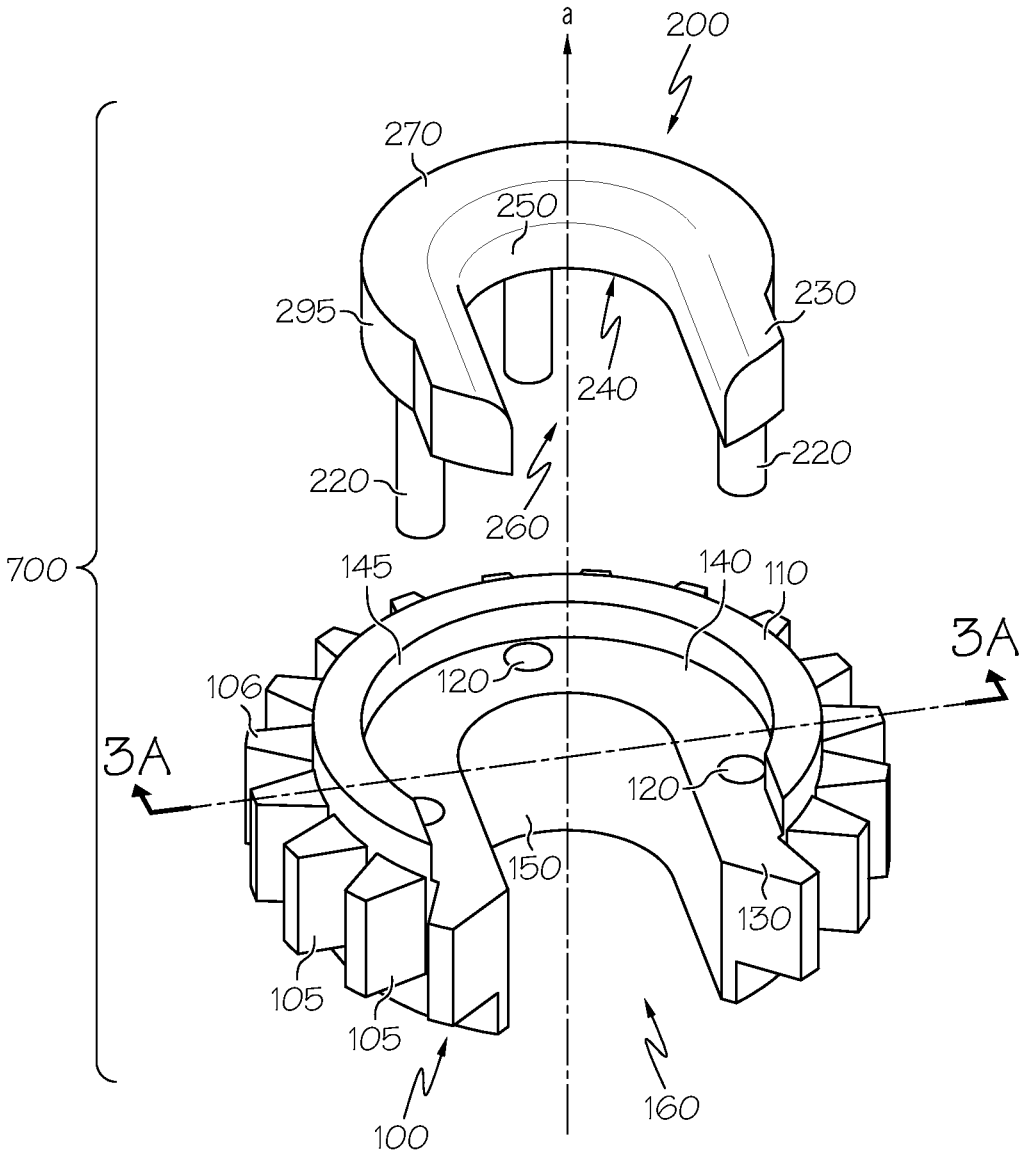
FIG. 2 schematically depicts an exploded view of a protective gear socket assembly comprising a gear socket having a plurality of mounting holes and an insert having a plurality of mounting posts, according to one or more embodiments shown and described herein.

FIG. 2 generally depicts an exploded view of a protective gear socket assembly. The protective gear socket assembly comprises a gear socket and an insert formed to fit on the gear socket. The gear socket comprises a plurality of teeth projecting radially outward from a perimeter of the gear socket and a u-shaped channel formed through a thickness of the gear socket. The u-shaped channel of the gear socket defines an opening at an edge of the gear socket. The gear socket further comprises a contact surface extending radially outward from an upper edge of the u-shaped channel of the gear socket, and a mounting hole formed in the contact surface extending axially downward. The insert comprises a u-shaped channel formed through a thickness of the insert. The u-shaped channel of the insert defines an opening at an edge of the insert, a mating surface extending radially outward from a lower edge of the u-shaped channel of the insert, and a mounting post protruding axially downward from the mating surface. When the insert is positioned in the gear socket, the u-shaped channel of the insert is aligned with the u-shaped channel of the gear socket, the mating surface of the insert is engaged with the contact surface of the gear socket, and the mounting post of the insert is received by the mounting hole of the gear socket. Protective gear socket assemblies and methods of fabricating the same will be described in more detail herein with specific reference to the corresponding drawings.

Figure 5:
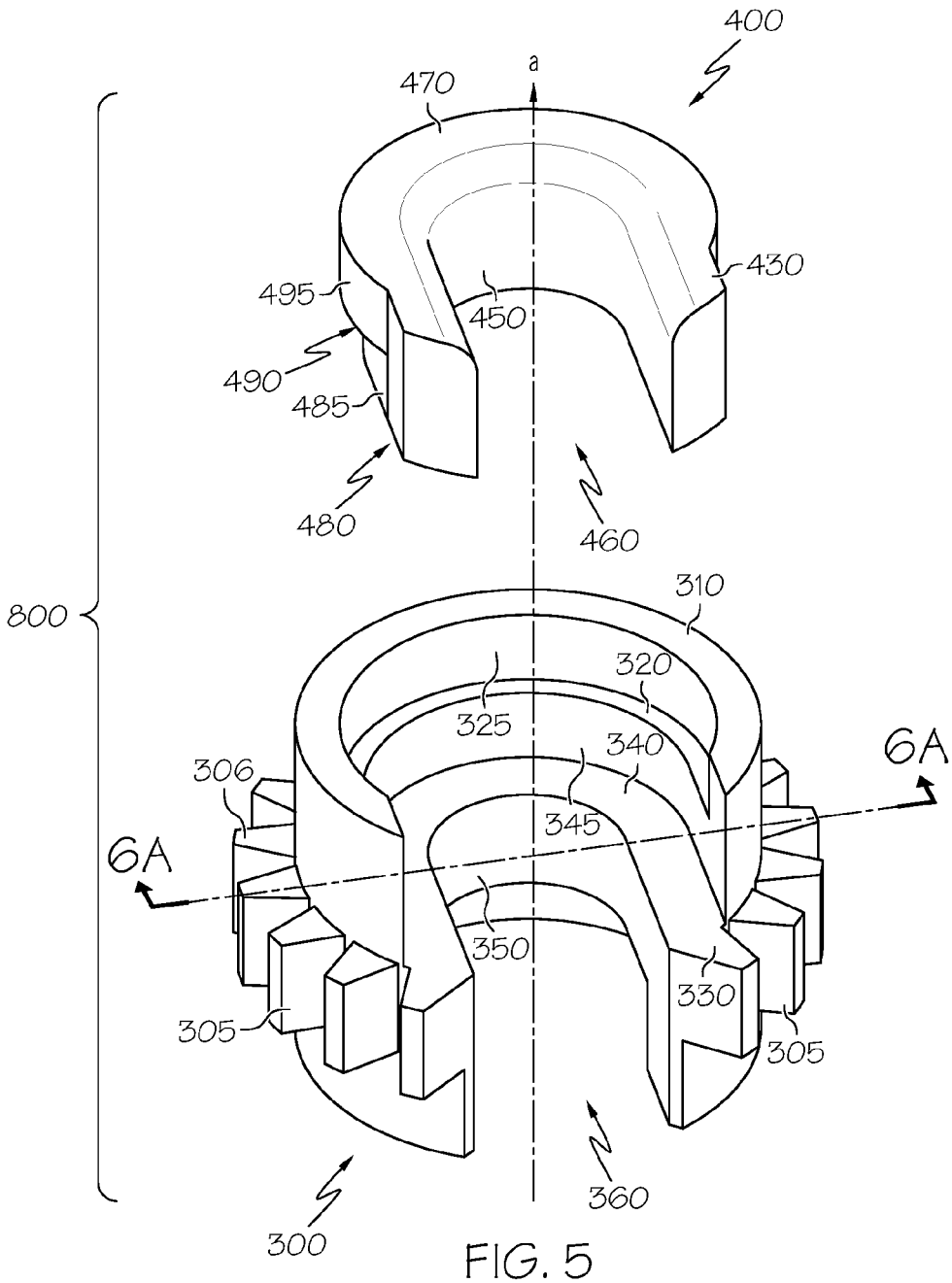
FIG. 5 schematically depicts an exploded view of a protective gear socket assembly comprising a gear socket and an insert formed to fit in the gear socket, according to one or more embodiments shown and described herein.

Coordinate axes are included in FIGS. 2 and 5 in order to provide a frame of reference for various components of the protective gear socket assemblies described herein. As used herein, "axially" is defined as along the a axis shown in the drawings. "Axially upward" is defined as the positive a direction of the a axis shown in the drawings. "Axially downward" is defined as the negative a direction of the a axis shown in the drawings. "Radially outward" is defined as extending away from the a axis shown in the drawings in a direction perpendicular to the a axis. "Radially inward" is defined as extending toward the a axis shown in the drawings in a direction perpendicular to the a axis.

Figure 1:
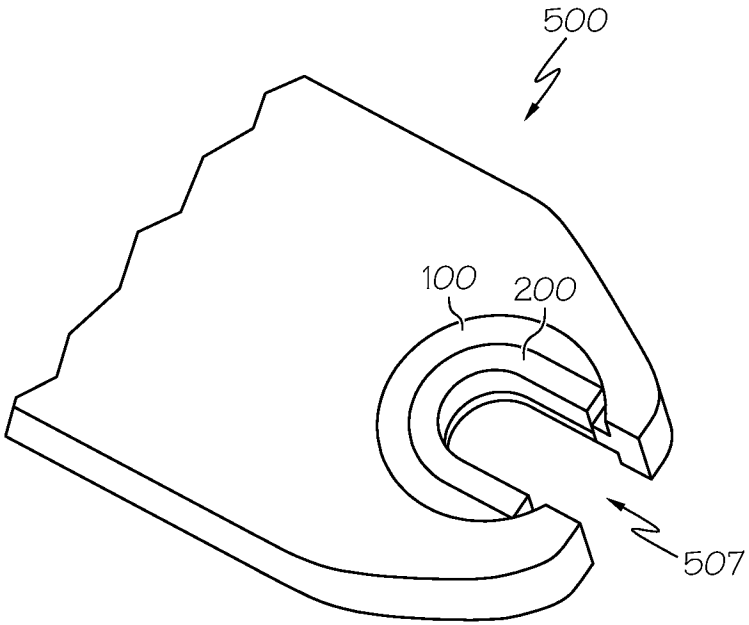
FIG. 1 schematically depicts a partial perspective view of a protective gear socket assembly comprising a gear socket and an insert positioned on the gear socket when the protective gear socket assembly is installed in a torque tool head, according to one or more embodiments shown and described herein.

Referring now to FIG. 1, a portion of an open end torque tool 500 is schematically depicted. The open end torque tool 500 generally comprises a drive shaft (not shown), the rotation of which rotates gears (not shown), and in turn the protective gear socket assembly comprising a gear socket 100 and an insert 200 affixed to the gear socket 100. As depicted in FIG. 1, the gear socket assembly comprising the gear socket 100 and the insert 200 is installed in the head of the open end torque tool 500. The open end torque tool 500 comprises a slot 507 that permits the open end torque tool 500 to be positioned such that the gear socket assembly can engage and rotate a nut.

Referring now to FIG. 2, a protective gear socket assembly 700 comprising a gear socket 100 and an insert 200 is schematically depicted. The gear socket 100 comprises a plurality of teeth 105 projecting radially outward from a perimeter of the gear socket 100 and a u-shaped channel 150 formed through a thickness of the gear socket 100. While the embodiment depicted in FIG. 2 comprises a u-shaped channel 150, in other embodiments, the channel may be shaped differently depending on the specific application for which the protective gear socket assembly 700 is used. For example, in one embodiment the channel formed through the thickness of the gear socket 100 may be rectangular or square.

Still referring to FIG. 2, the u-shaped channel 150 has an opening 160 at an edge of the gear socket 100. The width of the opening 160 is generally about the same as the maximum width of the u-shaped channel 150. The opening 160 permits the gear socket 100 to be engaged with a fastener disposed on a tube or similar element when the structure and configuration of the tube does not permit axial engagement of the fastener.

Still referring to FIG. 2, the gear socket 100 further comprises a contact surface 140 for receiving an insert 200. The contact surface 140 extends radially outward from an upper edge of the u-shaped channel 150 of the gear socket 100. While the contact surface 140 extends substantially perpendicularly from the u-shaped channel 150 in the embodiment depicted in FIG. 2, in other embodiments, the contact surface 140 may extend from the upper edge of the u-shaped channel 150 at an angle greater than or less than about 90° relative to the u-shaped channel 150. The contact surface 140 is substantially co-planar with a top surface 106 of the plurality of teeth 105. However, it should be understood that the contact surface 140 may be above or below the top surface 106 of the plurality of teeth 105.

In one embodiment, the gear socket 100 further comprises a plurality of mounting holes 120 formed in the contact surface 140, as depicted in FIG. 2. The plurality of mounting holes 120 generally extend in an axial direction (i.e., in the direction of the axis a depicted in FIG. 2). However, it should be understood that, in other embodiments, the plurality of mounting holes 120 may extend at an angle relative to the axis a of the gear socket 100. The mounting holes 120 are cylindrically shaped. However, it should be understood that the mounting holes 120 may have other cross-sectional shapes. Further, while the size and shape of the mounting holes 120 is substantially the same in the embodiment depicted in FIG. 2, in other embodiments, the mounting holes 120 may be formed with different sizes and/or shapes.

Still referring to FIG. 2, the gear socket 100 further comprises a semi-circular guide collar 110 extending circumferentially around the perimeter of the gear socket 100. The guide collar 110 facilitates stable rotation of the gear socket 100 in the tool head in which it is installed. The guide collar 110 is positioned radially inward of the plurality of teeth 105 and comprises a contact wall 145 extending axially upward (i.e., in the +a direction) from a radially outward edge of the contact surface 140. While the embodiment depicted in FIG. 2 comprises a guide collar 110 comprising a contact wall 145, other embodiments of the gear socket 100 (not shown) may be constructed without the guide collar 110 and the contact wall 145. For example, in some embodiments, the contact surface 140 may extend radially outward from an upper edge of the u-shaped channel 150 all the way to the plurality of teeth 105.

Figure 3A:
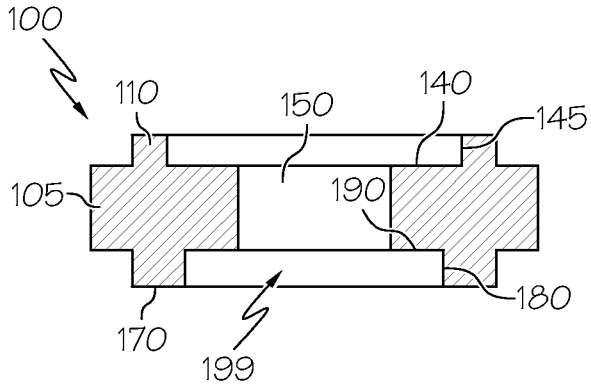
FIG. 3A schematically depicts a cross section of the gear socket of FIG. 2, according to one or more embodiments shown and described herein.
Figure 3B:
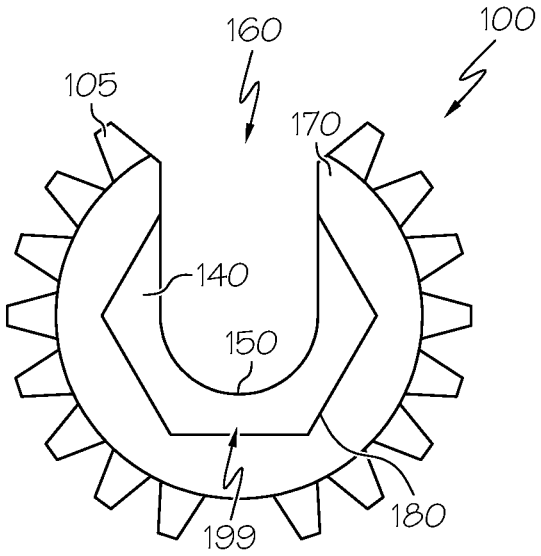
FIG. 3B schematically depicts a bottom view of the gear socket of FIG. 2, according to one or more embodiments shown and described herein.

Referring now to FIGS. 3A and 3B, which schematically depict a partial cross section of the gear socket 100 of FIG. 2 (FIG. 3A) and a bottom view of the gear socket 100 of FIG. 2 (FIG. 3B), the gear socket 100 further comprises a hexagonally shaped socket 199 for engaging and rotating a corresponding hexagonally shaped nut. The hexagonally shaped socket 199 is formed in the bottom surface 170 of the gear socket 100. The hexagonally shaped socket 199 comprises a nut contact wall 180 extending axially upward from the bottom surface 170. The hexagonally shaped socket 199 further comprises a nut engagement surface 190 extending radially inward from the nut contact wall 180. While the embodiments described herein comprise a hexagonally shaped socket 199, in other embodiments, the socket may have other shapes in order to accommodate nuts of other shapes. Further, in other embodiments, the gear socket 100 may not contain a hexagonally shaped socket 199.

The gear socket 100 is formed from metal. For example, the gear socket 100 may be formed from hardened tool steel. In the embodiments shown and described herein, the gear socket 100 is formed utilizing a computer numerical control ("CNC") machine to mill down a portion of a standard open end metal gear socket to form the contact surface 140 and to form the plurality of mounting holes 120. In other embodiments, the gear socket 100 may be directly fabricated with the contact surface 140 and the plurality of mounting holes 120. However, it should be understood that other materials and other forming processes can be used to construct the gear socket 100.

Figure 4B:
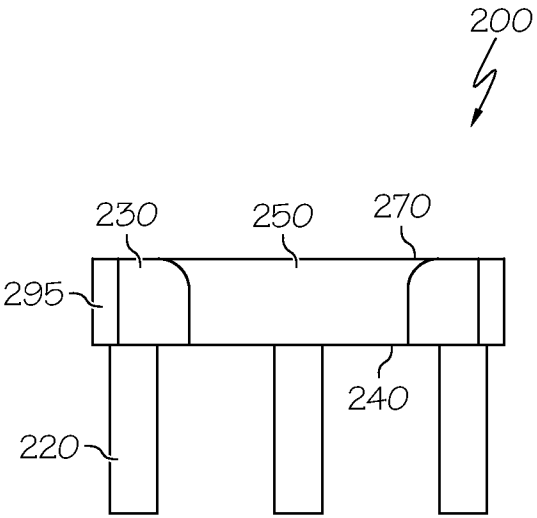
FIG. 4B schematically depicts a front view of the insert of FIG. 2, according to one or more embodiments shown and described herein.
Figure 4A:
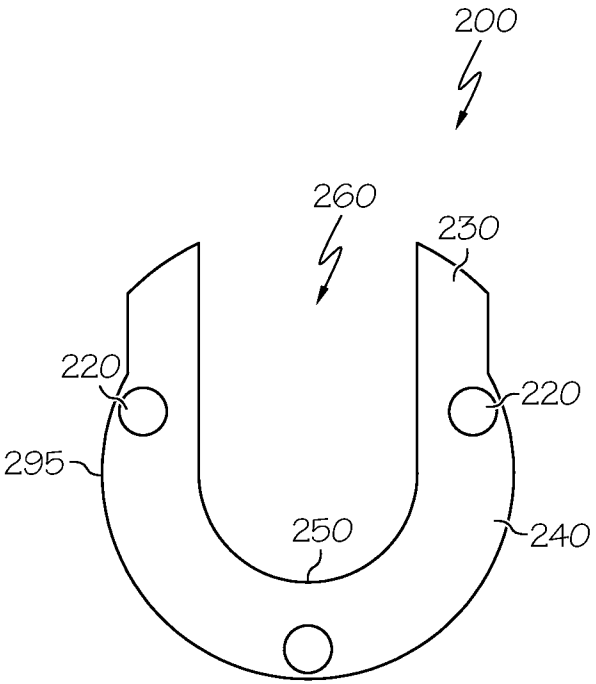
FIG. 4A schematically depicts a bottom view of the insert of FIG. 2, according to one or more embodiments shown and described herein.

Referring now to FIG. 2, FIG. 4A (schematically depicting a bottom view of the insert 200 of FIG. 2), and FIG. 4B (schematically depicting a front view of the insert 200 of FIG. 2), the insert 200 comprises a u-shaped channel 250 formed through a thickness of the insert 200. The u-shaped channel 250 of the insert 200 generally corresponds to the u-shaped channel 150 formed in the gear socket 100 described above. While the embodiment depicted in FIGS. 2, 4A, and 4B comprises a u-shaped channel 250, in other embodiments, the channel may be shaped differently depending on the shape of the u-shaped channel 150 formed in the gear socket 100. For example, in one embodiment the channel formed through the thickness of the insert 200 may be rectangular or square.

Still referring to FIGS. 2, 4A, and 4B, the u-shaped channel 250 defines an opening 260 at an edge of the insert 200. The width of the opening 260 is generally about the same as the maximum width of the u-shaped channel 250.

Still referring to FIGS. 2, 4A, and 4B, the insert 200 further comprises a mating surface 240 for mating with the contact surface 140 of the gear socket 100. The mating surface 240 extends radially outward from a lower edge of the u-shaped channel 250 of the insert 200. While the mating surface 240 extends substantially perpendicularly from the u-shaped channel 250 in the embodiment depicted in FIGS. 2, 4A, and 4B, in other embodiments, the mating surface 240 may extend from the lower edge of the u-shaped channel 250 at an angle greater than or less than about 90° relative to the u-shaped channel 250.

Still referring to FIGS. 2, 4A, and 4B, the insert 200 further comprises a plurality of mounting posts 220. In the embodiment depicted in FIGS. 2, 4A, and 4B, the plurality of mounting posts 220 protrude axially downward (i.e., in the −a direction of the axis a depicted in FIG. 2) from the mating surface 240. However, it should be understood that, in other embodiments, the plurality of mounting posts 220 may protrude from the mating surface 240 at an angle relative to the axis a. The mounting posts 220 generally correspond to the shape of the mounting holes 120 formed in the corresponding gear socket 100.

Still referring to FIGS. 2, 4A, and 4B, the insert 200 further comprises a perimeter mating wall 295 extending axially upward from a radially outward edge of the mating surface 240. While the perimeter mating wall 295 extends substantially perpendicularly from the mating surface 240 in the embodiment depicted in FIGS. 2, 4A, and 4B, in other embodiments, the perimeter mating wall 295 may extend from the mating surface 240 at an angle greater than or less than about 90° relative to the mating surface 240.

In the embodiments described herein, the insert 200 is fabricated from high density plastic, UHMW polyethylene, VHMW polyethylene, polyethylene, polyoxymethylene, or mylar. The insert 200 may be formed by CNC milling or injection molding. However, it should be understood that other materials and other forming processes can be used to fabricate the insert 200.

Referring once again to FIG. 2, the insert 200 is assembled to the gear socket 100 to form the protective gear socket assembly 700 by positioning the insert 200 over the gear socket 100 such that the u-shaped channel 250 of the insert 200 aligns with the u-shaped channel 150 of the gear socket 100 and the plurality of mounting holes 120 of the gear socket 100 align with the plurality of mounting posts 220 of the insert 200. Force is then applied to the insert 200 such that the mating surface 240 of the insert 200 engages the contact surface 140 of the gear socket 100, the plurality of mounting holes 120 of the gear socket 100 receive the corresponding plurality of mounting posts 220 of the insert 200, and the perimeter mating wall 295 of the insert 200 engages the contact wall 145 of the gear socket 100. In the embodiment depicted in FIG. 2, a thickness of the contact wall 145 of the gear socket is about the same as a thickness of the insert 200, such that a top surface 270 of the insert 200 is substantially flush with a top surface of the guide collar 110.

In some embodiments, the insert 200 is bonded to the gear socket 100 by an adhesive. In one embodiment, the adhesive is an epoxy. In other embodiments, the insert 200 is bonded to the gear socket 100 by heat staking the mounting posts 220 once they are positioned in the mounting holes 120. However, it should be understood that the insert 200 may be affixed to the gear socket 100 in other ways, for example, with mechanical fasteners, such as screws.

Referring now to FIG. 5, a protective gear socket assembly 800 comprising a gear socket 300 and an insert 400 is schematically depicted. The gear socket 300 comprises a plurality of teeth 305 projecting radially outward from a perimeter of the gear socket 300 and a u-shaped channel 350 formed through a thickness of the gear socket 300. While the embodiment depicted in FIG. 5 comprises a u-shaped channel 350, in other embodiments, the channel may be shaped differently depending on the specific application for which the protective gear socket assembly 800 is used. For example, in one embodiment the channel formed through the thickness of the gear socket 300 may be rectangular or square.

Still referring to FIG. 5, the u-shaped channel 350 defines an opening 360 at an edge of the gear socket 300. The width of the opening 360 is generally about the same as the maximum width of the u-shaped channel 350.

Still referring to FIG. 5, the gear socket 300 further comprises a first contact surface 340 for receiving an insert 400. The first contact surface 340 extends radially outward from an upper edge of the u-shaped channel 350 of the gear socket 300. While the first contact surface 340 extends substantially perpendicularly from the u-shaped channel 350 in the embodiment depicted in FIG. 5, in other embodiments, the first contact surface 340 may extend from the upper edge of the u-shaped channel 350 at an angle greater than or less than about 90° relative to the u-shaped channel 350. The first contact surface 340 may be even with, above, or below the top surface 306 of the plurality of teeth 305.

Still referring to FIG. 5, the gear socket 300 further comprises a first contact wall 345 for mating with an insert 400. The first contact wall 345 extends axially upward (i.e., in the +a direction of the axis a depicted in FIG. 5) from a radially outward edge of the first contact surface 340. While the first contact wall 345 extends substantially perpendicularly from the first contact surface 340 in the embodiment depicted in FIG. 5, in other embodiments, the first contact wall 345 may extend from the radially outward edge of the first contact surface 340 at an angle greater than or less than about 90° relative to the first contact surface 340.

Still referring to FIG. 5, the gear socket 300 further comprises a second contact surface 320 for mating with an insert 400. The second contact surface 320 extends radially outward from an upper edge of the first contact wall 345. While the second contact surface 320 extends substantially perpendicularly from the first contact wall 345 in the embodiment depicted in FIG. 5, in other embodiments, the second contact surface 320 may extend from the upper edge of the first contact wall 345 at an angle greater than or less than about 90° relative to the first contact wall 345.

Still referring to FIG. 5, the gear socket 300 further comprises a second contact wall 325 for mating with an insert 400. The second contact wall 325 extends axially upward (i.e., in the +a direction of the axis a depicted in FIG. 5) from a radially outward edge of the second contact surface 320. While the second contact wall 325 extends substantially perpendicularly from the second contact surface 320 in the embodiment depicted in FIG. 5, in other embodiments, the second contact wall 325 may extend from the radially outward edge of the second contact surface 320 at an angle greater than or less than about 90° relative to the second contact surface 320.

Figure 6A:
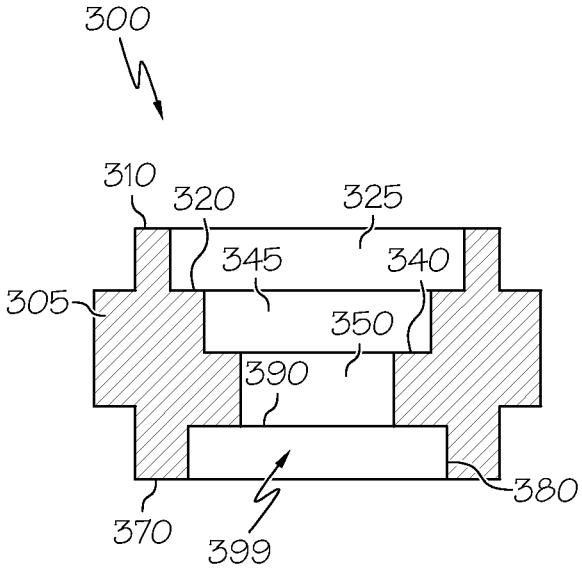
FIG. 6A schematically depicts a cross section of the gear socket of FIG. 5, according to one or more embodiments shown and described herein.
Figure 6B:
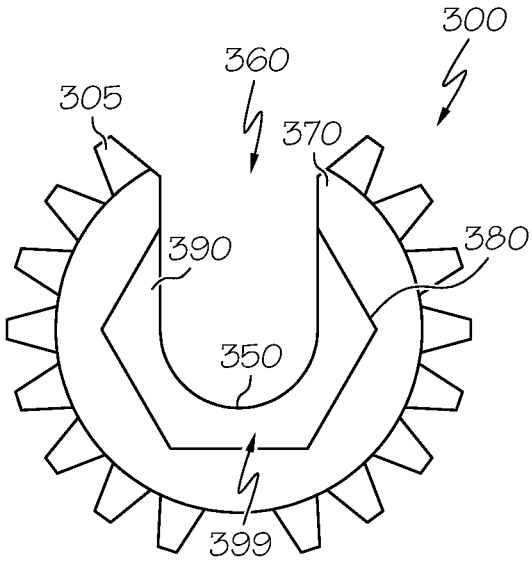
FIG. 6B schematically depicts a bottom view of the gear socket of FIG. 5, according to one or more embodiments shown and described herein.

Referring now to FIGS. 6A and 6B, which schematically depict a partial cross section of the gear socket 300 of FIG. 5 (FIG. 6A) and a bottom view of the gear socket 300 of FIG. 5 (FIG. 6B), the gear socket 300 further comprises a hexagonally shaped socket 399 for engaging and rotating a corresponding hexagonally shaped nut. The hexagonally shaped socket 399 is formed in the bottom surface 370 of the gear socket 300. The hexagonally shaped socket 399 comprises a nut contact wall 380 extending axially upward from the bottom surface 370. The hexagonally shaped socket 399 further comprises a nut engagement surface 390 extending radially inward from the nut contact wall 380. While the embodiments described herein comprise a hexagonally shaped socket 399, in other embodiments, the socket may have other shapes in order to accommodate nuts of other shapes. Further, in other embodiments, the gear socket 300 may not contain a hexagonally shaped socket 399.

The gear socket 300 is formed from metal. For example, the gear socket 300 may be formed from hardened tool steel. In the embodiments shown and described herein, the gear socket 300 is formed utilizing a computer numerical control ("CNC") machine to mill down a portion of a standard open end metal gear socket to form the first contact surface 340 and the second contact surface 320. In other embodiments, the gear socket 300 may be directly fabricated to include the first contact surface 340 and the second contact surface 320. However, it should be understood that other materials and other forming processes can be used to construct the gear socket 300.

Figure 7B:
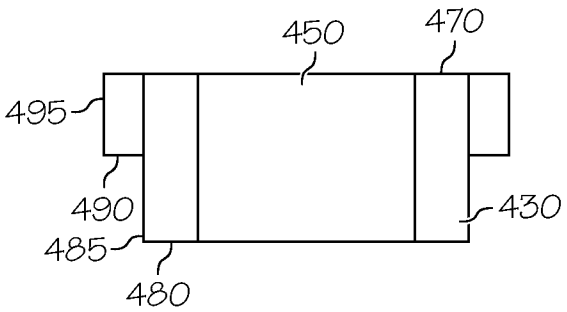
FIG. 7B schematically depicts a front view of the insert of FIG. 5, according to one or more embodiments shown and described herein.
Figure 7A:
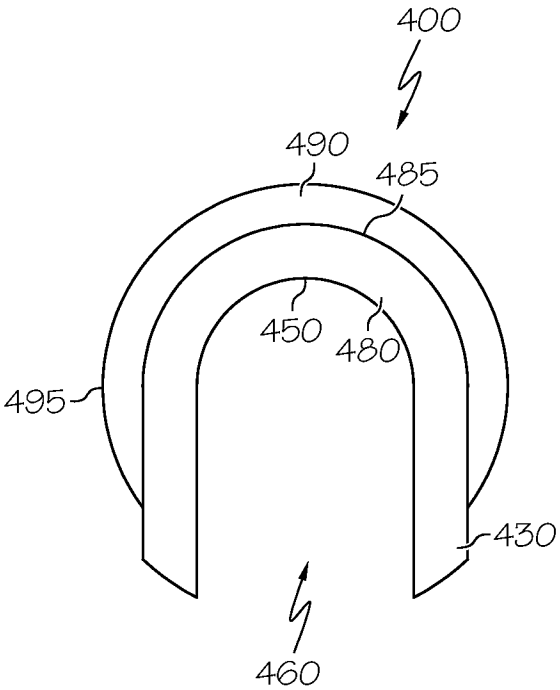
FIG. 7A schematically depicts a bottom view of the insert of FIG. 5, according to one or more embodiments shown and described herein.

Referring now to FIGS. 5, FIG. 7A (schematically depicting a bottom view of the insert 400 of FIG. 5), and FIG. 7B (schematically depicting a front view of the insert 400 of FIG. 5), the insert 400 comprises a u-shaped channel 450 formed through a thickness of the insert 400. The u-shaped channel 450 of the insert 400 generally corresponds to the u-shaped channel 350 formed in the gear socket 300 described above. While the embodiment depicted in FIGS. 5, 7A, and 7B comprises a u-shaped channel 450, in other embodiments, the channel may be shaped differently depending on the shape of the u-shaped channel 350 formed in the gear socket 300. For example, in one embodiment the channel formed through the thickness of the insert 400 may be rectangular or square.

Still referring to FIGS. 5, 7A, and 7B, the u-shaped channel 450 defines an opening 460 at an edge of the insert 400. The width of the opening 460 is generally about the same as the maximum width of the u-shaped channel 450.

Still referring to FIGS. 5, 7A, and 7B, the insert 400 further comprises a first mating surface 480 for mating with the first contact surface 340 of the gear socket 300. The first mating surface 480 extends radially outward from a lower edge of the u-shaped channel 450 of the insert 400. While the first mating surface 480 extends substantially perpendicularly from the u-shaped channel 450 in the embodiment depicted in FIGS. 5, 7A, and 7B, in other embodiments, the first mating surface 480 may extend from the lower edge of the u-shaped channel 450 at an angle greater than or less than about 90° relative to the u-shaped channel 450.

Still referring to FIGS. 5, 7A, and 7B, the insert 400 further comprises a first mating wall 485 for engaging with a corresponding contact wall of the gear socket 300. The first mating wall 485 extends axially upward from a radially outward edge of the first mating surface 480. While the first mating wall 485 extends substantially perpendicularly from the first mating surface 480 in the embodiment depicted in FIGS. 5, 7A, and 7B, in other embodiments, the first mating wall 485 may extend from the first mating surface 480 at an angle greater than or less than about 90° relative to the first mating surface 480.

Still referring to FIGS. 5, 7A, and 7B, the insert 400 further comprises a second mating surface 490 for mating with the second contact surface 320 of the gear socket 300. The second mating surface 490 extends radially outward from an upper edge of the first mating wall 485 of the insert 400. While the second mating surface 490 extends substantially perpendicularly from the first mating wall 485 in the embodiment depicted in FIGS. 5, 7A, and 7B, in other embodiments, the second mating surface 490 may extend from the first mating wall 485 at an angle greater than or less than about 90° relative to the first mating wall 485.

Still referring to FIGS. 5, 7A, and 7B, the insert 400 further comprises a second mating wall 495 for mating with a corresponding contact wall of the gear socket 300. The second mating wall 495 extends axially upward from a radially outward edge of the second mating surface 490. While the second mating wall 495 extends substantially perpendicularly from the second mating surface 490 in the embodiment depicted in FIGS. 5, 7A, and 7B, in other embodiments, the second mating wall 495 may extend from the second mating surface 490 at an angle greater than or less than about 90° relative to the second mating surface 490.

While the embodiment depicted in FIG. 5 comprises a gear socket 300 with two contact surfaces and an insert 400 with two mating surfaces, in other embodiments, the gear socket 300 may have only one contact surface and the insert 400 may have only one corresponding mating surface. In still other embodiments, the gear socket 300 may have more than two contact surfaces and the insert 400 may have more than two corresponding mating surfaces.

In the embodiments described herein, the insert 400 is fabricated from high density plastic, UHMW polyethylene, VHMW polyethylene, polyethylene, polyoxymethylene, or mylar. The insert 400 may be formed by CNC milling or injection molding. However, it should be understood that other materials and other forming processes can be used to fabricate the insert 400.

Referring once again to FIG. 5, the insert 400 is assembled to the gear socket 300 to form the protective gear socket assembly 800 by positioning the insert 400 over the gear socket 300 such that the u-shaped channel 450 of the insert 400 aligns with the u-shaped channel 350 of the gear socket 300. Force is then applied to the insert 400 such that the first mating surface 480 of the insert 400 engages the first contact surface 340 of the gear socket 300, the first mating wall 485 of the insert 400 engages the first contact wall 345 of the gear socket 300, the second mating surface 490 of the insert 400 engages the second contact surface 320 of the gear socket 300, and the second mating wall 495 of the insert 400 engages the second contact wall 325 of the gear socket 300. In the embodiment depicted in FIG. 5, a thickness of the first contact wall 345 of the gear socket 300 is about the same as a thickness of the first mating wall 485 of the insert 400, such that a top surface 470 of the insert 400 is substantially flush with a top surface of the guide collar 310.

In some embodiments, the insert 400 is bonded to the gear socket 300 by an adhesive. In one embodiment, the adhesive is an epoxy. In other embodiments, the insert 400 is bonded to the gear socket 300 by heat staking the insert 400 in multiple places. However, it should be understood that the insert 400 may be affixed to the gear socket 300 in other ways, for example, with mechanical fasteners, such as screws.

When a protective gear socket assembly as described and illustrated herein is installed in the head of a torque tool, the torque tool can be used to tighten flare nuts associated with brake tubes and/or rack and pinion fluid tubes. In order to tighten a flare nut, the torque tool is slid onto the tube such that the tube enters the opening of the gear socket assembly. The torque tool is then lowered onto the flare nut associated with the tube such that the socket of the protective gear socket assembly engages the flare nut. The drive shaft of the torque tool is then rotated such that the flare nut is rotated by the protective gear socket assembly. Using a torque tool equipped with such a protective gear socket assembly to tighten flare nuts on such tubes may avoid damage to the tubes when the torque tool is inserted and removed from the tube.

It should now be understood that the protective gear socket assembly comprising a gear socket and an insert affixed to the gear socket reduces the surface area of protective coatings of tubes that may be in contact with the gear socket when the gear socket is used to rotate nuts in close proximity to the tubes, thereby reducing the possibility of nicks and scratches to the protective coatings.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A protective gear socket assembly comprising:

a gear socket comprising:

a plurality of teeth projecting radially outward from a perimeter of the gear socket;

a u-shaped channel formed through a thickness of the gear socket, the u-shaped channel of the gear socket defining an opening at an edge of the gear socket;

a contact surface extending radially outward from an upper edge of the u-shaped channel of the gear socket; and at least one mounting hole formed in the contact surface;

an insert positioned in the gear socket, the insert comprising:

a u-shaped channel formed through a thickness of the insert, the u-shaped channel of the insert defining an opening at an edge of the insert;

a mating surface extending radially outward from a lower edge of the u-shaped channel of the insert; and at least one mounting post extending from the mating surface, wherein when the insert is positioned on the gear socket, the u-shaped channel of the insert is aligned with the u-shaped channel of the gear socket, the mating surface of the insert engages the contact surface of the gear socket, and the at least one mounting hole of the gear socket receives the at least one mounting post of the insert.

2. The protective gear socket assembly of claim 1 wherein:

the gear socket further comprises a guide collar, the guide collar comprising a contact wall extending axially upward from a radially outward edge of the contact surface; and the insert further comprises a perimeter mating wall extending axially upward from a radially outward edge of the mating surface, wherein when the insert is positioned on the gear socket, the perimeter mating wall of the insert engages the contact wall of the gear socket.

3. The protective gear socket assembly of claim 2 wherein a thickness of the guide collar of the gear socket is about the same as a thickness of the insert.

4. The protective gear socket assembly of claim 1 wherein the at least one mounting hole of the gear socket is cylindrical and the at least one mounting post of the insert is cylindrical.

5. The protective gear socket assembly of claim 1 wherein the insert is formed from a material selected form the group consisting of: high density plastic, UHMW polyethylene, VHMW polyethylene, polyethylene, polyoxymethylene, and mylar.

6. The protective gear socket assembly of claim 1 wherein the gear socket further comprises a hexagonally shaped socket on a bottom of the gear socket for engaging a nut.

7. The protective gear socket assembly of claim 1 wherein the gear socket is formed from metal.

8. The protective gear socket assembly of claim 1 wherein the insert is bonded to the gear socket with an adhesive.

9. The protective gear socket assembly of claim 8 wherein the adhesive is an epoxy.

10. The protective gear socket assembly of claim 1 wherein the insert is bonded to the gear socket by heat staking.

11. A protective gear socket assembly comprising:

a gear socket comprising:

a plurality of teeth projecting radially outward from a perimeter of the gear socket;

a u-shaped channel formed through a thickness of the gear socket, the u-shaped channel of the gear socket defining an opening at an edge of the gear socket;

a first contact surface extending radially outward from an upper edge of the u-shaped channel of the gear socket;

a first contact wall extending axially upward from a radially outward edge of the first contact surface; and an insert positioned on the gear socket, the insert comprising:

a u-shaped channel formed through a thickness of the insert, the u-shaped channel of the insert defining an opening at an edge of the insert;

a first mating surface extending radially outward from a lower edge of the u-shaped channel of the insert; and a first mating wall extending axially upward from a radially outward edge of the first mating surface, wherein when the insert is positioned on the gear socket, the u-shaped channel of the insert is aligned with the u-shaped channel of the gear socket, the first mating surface of the insert engages the first contact surface of the gear socket, and the first mating wall of the insert engages the first contact wall of the gear socket.

12. The protective gear socket assembly of claim 11 wherein:

the gear socket further comprises a second contact surface extending radially outward from an upper edge of the first contact wall, and a second contact wall extending axially upward from a radially outward edge of the second contact surface; and the insert further comprises a second mating surface extending radially outward from an upper edge of the first mating wall, and a second mating wall extending axially upward from a radially outward edge of the second mating surface, wherein when the insert is positioned on the gear socket, the second mating surface of the insert engages the second contact surface of the gear socket, and the second mating wall of the insert engages the second contact wall of the gear socket.

13. The protective gear socket assembly of claim 12 wherein a thickness of the first contact wall of the gear socket is about the same as a thickness of the first mating wall of the insert and a thickness of the second contact wall of the gear socket is about the same as a thickness of the second mating wall of the insert.

14. The protective gear socket assembly of claim 11 wherein the gear socket further comprises a hexagonally shaped socket on a bottom of the gear socket for engaging a nut.

15. The protective gear socket assembly of claim 11 wherein the insert is formed from a material selected from the group consisting of: high density plastic, UHMW polyethylene, VHMW polyethylene, polyethylene, polyoxymethylene, and mylar.

16. The protective gear socket assembly of claim 11 wherein the insert is bonded to the gear socket with an adhesive.

17. A method of fabricating a protective gear socket assembly comprising:

providing a gear socket comprising a plurality of teeth projecting radially outward from a perimeter of the gear socket, a u-shaped channel formed through a thickness of the gear socket and defining an opening at an edge of the gear socket, and a contact surface extending radially outward from an upper edge of the u-shaped channel of the gear socket;

fabricating an insert comprising a u-shaped channel formed through a thickness of the insert and defining an opening at an edge of the insert, a mating surface extending radially outward from a lower edge of the u-shaped channel of the insert;

positioning the insert over the gear socket such that the u-shaped channel of the insert is aligned with the u-shaped channel of the gear socket; and applying force to the insert such that the mating surface of the insert engages the contact surface of the gear socket, thereby forming a protective gear socket assembly.

18. The method of claim 17 further comprising forming at least one mounting hole in the contact surface of the gear socket wherein:

the insert further comprises at least one mounting post extending from the mating surface;

the at least one mounting hole of the gear socket aligns with the at least one mounting post of the insert when the insert is positioned over the gear socket; and the at least one mounting hole of the gear socket receives the at least one mounting post of the insert when force is applied to the insert.

19. The method of claim 17 further comprising bonding the insert to the gear socket with an adhesive.

20. The method of claim 17 wherein the insert is fabricated from a material selected from the group consisting of: high density plastic, UHMW polyethylene, VHMW polyethylene, polyethylene, polyoxymethylene, and mylar.

* * * * *

UNITED STATES PATENT AND TRADEMARK OFFICE

CERTIFICATE OF CORRECTION

PATENT NO. : 8,590,431 B2
APPLICATION NO. : 13/248554
DATED : November 26, 2013
INVENTOR(S) : Allen Mark Cook It is certified that error appears in the above-identified patent and that said Letters Patent is hereby corrected as shown below:

In the claims:

In Claim 5, line 43 of column 10, ". . . selected form the group . . ." has been changed to ". . . selected from the group . . ."

Signed and Sealed this
Eighteenth Day of February, 2014

Michelle K. Lee

Michelle K. Lee
*Deputy Director of the United States Patent and Trademark Office*